US008222815B2

(12) United States Patent
Kweon et al.

(10) Patent No.: US 8,222,815 B2
(45) Date of Patent: Jul. 17, 2012

(54) PLASMA DISPLAY PANEL

(75) Inventors: Tae-Joung Kweon, Suwon-si (KR); Sung-Hune Yoo, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 422 days.

(21) Appl. No.: 12/461,796

(22) Filed: Aug. 25, 2009

(65) Prior Publication Data

US 2010/0109982 A1 May 6, 2010

(30) Foreign Application Priority Data

Nov. 6, 2008 (KR) ..... 10-2008-0110011

(51) Int. Cl.
*H01J 17/42* (2006.01)

(52) U.S. Cl. ..... 313/587; 313/584

(58) Field of Classification Search ..... None
See application file for complete search history.

(56) References Cited

U.S. PATENT DOCUMENTS

2009/0102379 A1* 4/2009 Inoue et al. ..... 313/582
2009/0115335 A1* 5/2009 Hasegawa et al. ..... 313/586
2009/0230861 A1* 9/2009 Miyazaki et al. ..... 313/582

FOREIGN PATENT DOCUMENTS

KR 10 2006-0067138 A 6/2006

OTHER PUBLICATIONS

Korean Registration Determination Certificate in KR 10-2008-0110011, dated Sep. 27, 2010 (Kweon, et al.).

* cited by examiner

*Primary Examiner* — Ashok Patel
(74) *Attorney, Agent, or Firm* — Lee & Morse, P.C.

(57) ABSTRACT

A PDP includes a first substrate and a second substrate facing each other, a plurality of first discharge electrodes on the first substrate, a first dielectric layer covering the plurality of first discharge electrodes, and a plurality of second discharge electrodes on the second substrate to cross the plurality of first discharge electrodes, wherein a difference between thermal expansion coefficients of the first substrate and the first dielectric layer is greater than or equal to about $2\times10^{-7}/°$ C. and less than or equal to about $17\times10^{-7}/°$ C.

12 Claims, 2 Drawing Sheets

PLASMA DISPLAY PANEL

BACKGROUND

1. Field

Embodiments relate to a plasma display panel (PDP) and, more particularly, to a PDP that can reduce or prevent substrate deformation resulting from a mismatch between a thermal expansion coefficient of a substrate and a thermal expansion coefficient of a dielectric layer.

2. Description of the Related Art

In general, a PDP is a flat display device in which a predetermined discharge gas is injected between two substrates having a plurality of discharge electrodes thereon to generate a mutual discharge. Vacuum ultraviolet radiation generated by the mutual discharge excites phosphor materials of phosphor layers, thereby realizing display of desired numerals, text, or graphics.

Due to the recent demand for large PDPs, a multi-cutting process technology that enables simultaneous production of a plurality of, e.g., two to eight divided glass substrates from a mother glass is used in a manufacturing process to improve efficiency. That is, the mother glass can be divided into unit substrates by forming various pattern layers, e.g., pairs of discharge electrodes, a dielectric layer formed to cover the pairs of discharge electrodes, barrier ribs, phosphor layers, and frit glass, are formed on each of the unit substrates, and then, cutting a border portion between each of the unit substrates of the mother glass to form unit substrates.

However, conventional PDPs have problems in that, as multiple substrates are obtained at the same time, the substrates are vulnerable to damage due to differences in bending, thermal deformation, contraction, and so forth.

SUMMARY

Embodiments are therefore directed to a PDP, which substantially overcome one or more of the problems due to the limitations and disadvantages of the related art.

It is therefore a feature of an embodiment to provide a PDP having an improved structure in which a difference between thermal expansion coefficients of a substrate and a dielectric layer formed on the substrate is limited to a specific range so as to reduce a mismatch between the thermal expansion coefficients, thereby preventing warping of a panel.

At least one of the above and other features and advantages may be realized by providing a first substrate and a second substrate facing each other, a plurality of first discharge electrodes on the first substrate, a first dielectric layer covering the plurality of first discharge electrodes, a plurality of second discharge electrodes on the second substrate to cross the plurality of first discharge electrodes, and a second dielectric layer covering the plurality of second discharge electrodes, wherein a difference between thermal expansion coefficients of the first substrate and the first dielectric layer may be greater than or equal to about $2\times10^{-7}/°$ C. and less than or equal to about $17\times10^{-7}/°$ C.

The plurality of first discharge electrodes may be a plurality of pairs of sustain electrodes disposed in a direction of the first substrate, and the plurality of second discharge electrodes are a plurality of address electrodes disposed in a direction of the second substrate.

The first substrate may be formed on a high distortion point glass having the thermal expansion coefficient of about $77\times10^{-7}/°$ C. to about $87\times10^{-7}/°$ C.

The first dielectric layer may include at least one of a lead based material, a bismuth-based material, a boron-zinc-based material, and a boron-alumina-based material.

The lead-based material may have the thermal expansion coefficient of about $60\times10^{-7}/°$ C. to about $85\times10^{-7}/°$ C., the bismuth-based material may have the thermal expansion coefficient of about $65\times10^{-7}/°$ C. to about $90\times10^{-7}/°$ C., the boron-zinc-based material may have the thermal expansion coefficient of about $75\times10^{-7}/°$ C. to about $95\times10^{-7}/°$ C., and the boron-alumina-based material may have the thermal expansion coefficient of about $70\times10^{-7}/°$ C. to about $90\times10^{-7}/°$ C.

The first substrate may be a substrate through which visible light penetrates.

The PDP may further include a protective layer on a surface of the first dielectric layer.

At least one of the above and other features and advantages may also be realized by providing a PDP including a substrate, a plurality of discharge electrodes on the substrate, and a dielectric layer covering the plurality of discharge electrodes, wherein a difference between thermal expansion coefficients of the substrate and the dielectric layer may be greater than or equal to about $2\times10^{-7}/°$ C. and less than or equal to about $17\times10^{-7}/°$ C.

The substrate may be formed of a high distortion point glass having the thermal expansion coefficient of about $77\times10^{-7}/°$ C. to about $87\times10^{-7}/°$ C.

The dielectric layer may include at least one of a lead based material, a bismuth-based material, a boron-zinc-based material, or a boron-alumina-based material.

The lead-based material may have the thermal expansion coefficient of about $60\times10^{-7}/°$ C. to about $85\times10^{-7}/°$ C., the bismuth-based material may have the thermal expansion coefficient of about $65\times10^{-7}/°$ C. to about $90\times10^{-7}/°$ C., the boron-zinc-based material may have the thermal expansion coefficient of about $75\times10^{-7}/°$ C. to about $95\times10^{-7}/°$ C., and the boron-alumina-based material may have the thermal expansion coefficient of about $70\times10^{-7}/°$ C. to about $90\times10^{-7}/°$ C.

The plurality of discharge electrodes may be a plurality of pairs of sustain electrodes.

The substrate may be a substrate through which visible light penetrates.

The PDP may further include a protective layer on a surface of the dielectric layer.

BRIEF DESCRIPTION OF THE DRAWINGS

The above and other features and advantages will become more apparent to those of ordinary skill in the art by describing in detail exemplary embodiments with reference to the attached drawings, in which.

DETAILED DESCRIPTION

Figure 1:
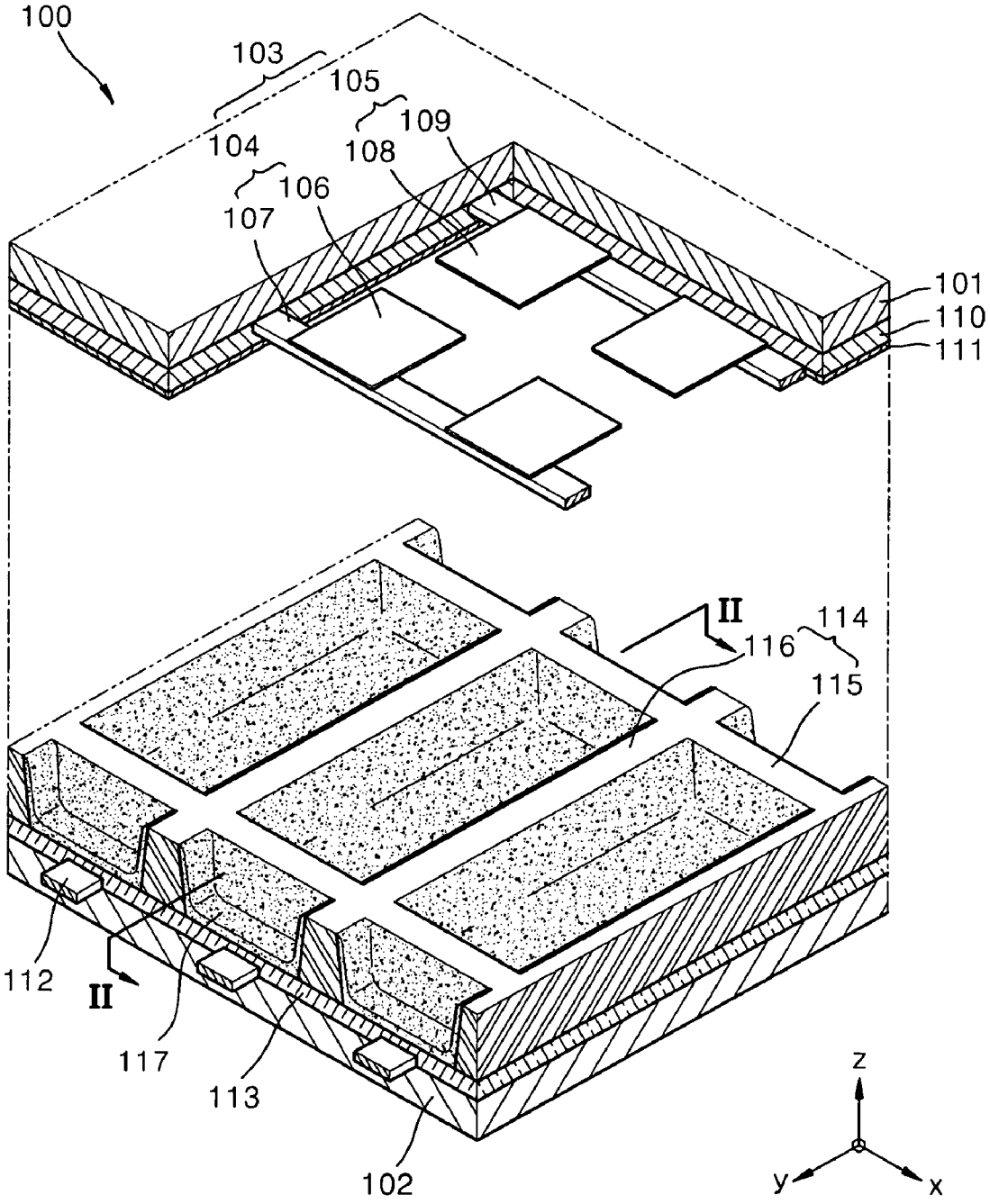
FIG. 1 illustrates an exploded perspective view of a PDP according to an embodiment.

Korean Patent Application No. 10-2008-0110011, filed on Nov. 6, 2008, in the Korean Intellectual Property Office, and entitled: "Plasma Display Panel," is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
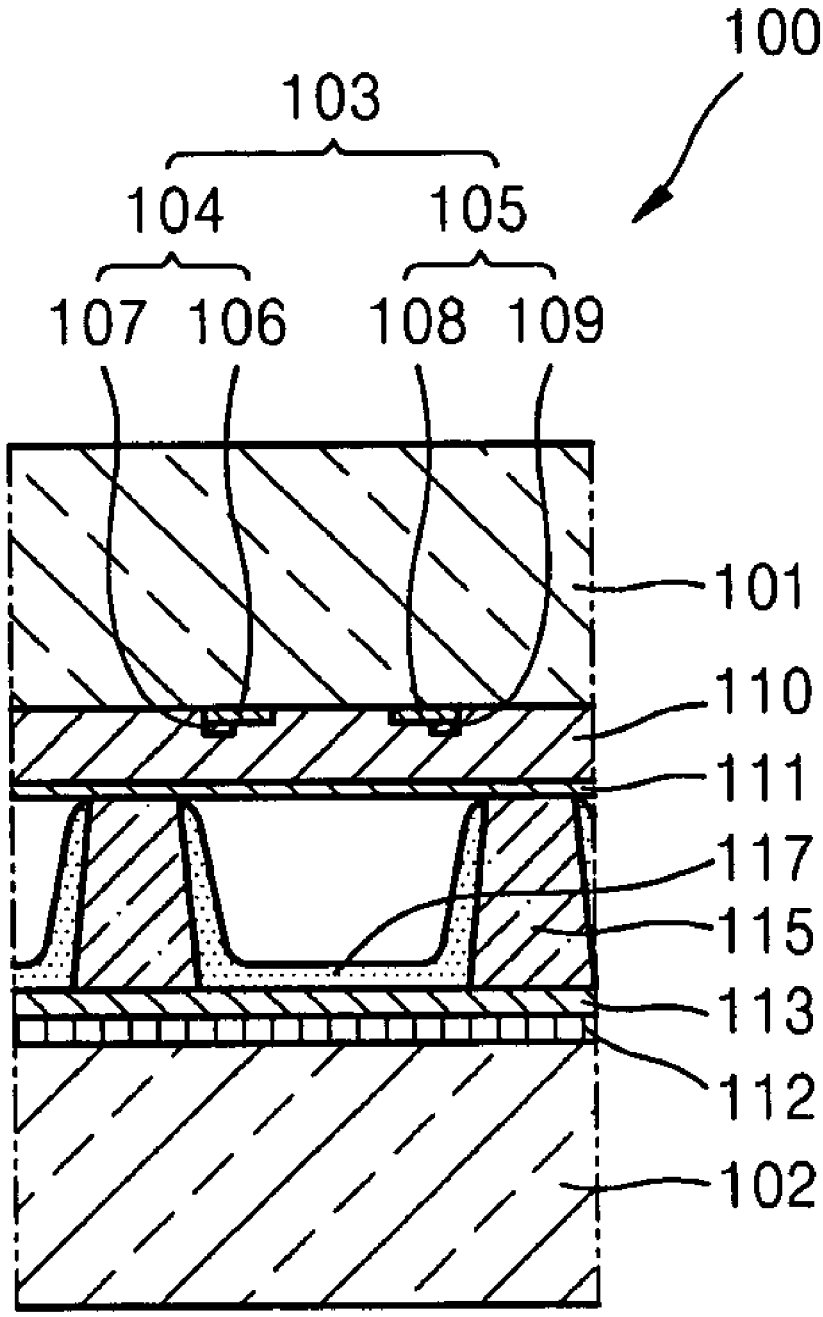
FIG. 2 illustrates a vertical cross-sectional view of the PDP of FIG. 1, taken along a line II-II.

FIG. 1 illustrates an exploded perspective view of a three-electrode surface discharge type PDP 100 according to an embodiment. FIG. 2 illustrates a vertical cross-sectional view of the PDP 100 of FIG. 1, taken along a line II-II.

Referring to FIGS. 1 and 2, the PDP 100 may include a first substrate 101 and a second substrate 102 disposed to face the first substrate 101. To form a sealed discharge space between the first substrate 101 and the second substrate 102, frit glass (not shown) may be coated on edges of opposite inner surfaces of the first substrate 101 and the second substrate 102.

The first substrate 101 may be formed as a transparent substrate, e.g., soda lime glass or PD-200 of Asahi Glass Co., Ltd. (Japan), a translucent substrate, a reflective substrate, or a colored substrate.

Pairs of sustain electrodes 103, each pair including an X electrode 104 and a Y electrode 105, may be disposed in the first substrate 101. The pair of X and Y electrodes 104 and 105 may be disposed in each discharge cell of the PDP 100.

The X electrodes 104 may include X transparent electrodes 106, each independently disposed in each discharge cell of the PDP 100, and an X bus electrode line 107 extending along an x-axis direction of the PDP 100 to be parallel to the discharge cells adjacent to each other and electrically connecting the X transparent electrodes 106. The X transparent electrode 106 may extend from the X bus electrode line 107 toward a center of the discharge cell along the y-axis direction.

The Y electrodes 105 may include Y transparent electrodes 108, each independently disposed in each discharge cell of the PDP 100, and a Y bus electrode line 109 extending along the x-axis direction of the PDP 100 to be parallel to discharge cells adjacent to each other and electrically connecting the Y transparent electrodes 108. The Y transparent electrode 108 may extend from the Y bus electrode line 109 toward a center of the discharge cell along the y-axis direction.

The X transparent electrodes 106 and Y transparent electrodes 108 individually may have a quadrangle shaped cross-sectional area, and may be disposed apart from each other by a predetermined distance at the center of each of the discharge cells, thereby forming individual discharge gaps. The X bus electrode line 107 and the Y bus electrode line 109 may be disposed along both edges of a surface facing the discharge cells, and may be formed in a striped pattern.

The X transparent electrodes 106 and Y transparent electrodes 108 may be formed as a transparent conductive layer, e.g., an indium tin oxide (ITO) layer. The X bus electrode line 107 and the Y bus electrode line 109 may be formed of highly conductive material, e.g., a silver paste or a chrome-copper-chrome (Cr—Cu—Cr) alloy.

A first dielectric layer 110 may be formed to cover the X electrodes 104 and Y electrodes 105. That is, the X electrodes 104 and Y electrodes 105 may be patterned on a surface of the first substrate 101, and the first dielectric layer 110 may be formed on surfaces of the X electrodes 104 and Y electrodes 105 to cover the X electrodes 104 and Y electrodes 105. Here, visible light may penetrate the first substrate 101.

A protective layer 111, e.g., a magnesium oxide (MgO) layer, may be formed on a surface of the first dielectric layer 110 to increase the amount of secondary electron emission. The protective layer 111 may be deposited on the surface of the first dielectric layer 110.

The second substrate 102 may be formed as, e.g., a transparent substrate, a translucent substrate, a reflective substrate, or a colored substrate. A plurality of address electrodes 112 may be formed in the second substrate 102 along the y-axis direction to cross the X and Y electrodes 104 and 105.

The address electrodes 112 may extend along the y-axis direction of the PDP 100 and correspond to the discharge cells. For example, each address electrode 112 may correspond to one discharge cell. The address electrodes 112 may be formed in a stripe. A second dielectric layer 113 may cover the address electrodes 112. The second dielectric layer 113 may be formed of a high dielectric material, which is the same as that of the first dielectric layer 110.

A plurality of barrier ribs 114 may be disposed between the first substrate 101 and the second substrate 102 to define each of the discharge cells and to prevent cross-talk between adjacent discharge cells.

The barrier ribs 114 may include first barrier ribs 115 disposed along the x-axis direction of the PDP 100, and second barrier ribs 116 disposed along the y-axis direction of the PDP 100. The first barrier ribs 115 and the second barrier ribs 116 may be joined to each other forming a matrix and partitioning the discharge cells.

A structure of each of the barrier ribs 114 may not limited to the current embodiment, but may be other structures capable of defining the discharge cells. Accordingly, cross-sectional areas of the discharge cells may have various shapes, e.g., a polygonal shape, a circular shape, and an oval shape, as well as the quadrangular shape illustrated.

A discharge gas, e.g., neon (Ne)-xenon (Xe) or helium (He)-xenon (Xe), may be injected into the discharge cells partitioned by the first substrate 101, the second substrate 102, and the barrier ribs 114.

Also, a plurality of phosphor layers 117 may be formed in the discharge cells, so as to be excited by ultraviolet radiation generated from the discharge gas and to emit visible light, which is used to form color images. The phosphor layers 117 may be coated on any region in the discharge cells. In the current embodiment, the phosphor layers 117 may be coated on a top surface of the second dielectric layer 113 and inner side walls 115 of the barrier ribs 114.

The phosphor layers 117 may be formed as red, green, and blue phosphor layers in the present embodiment, but may not be limited thereto. In the current embodiment, the red phosphor layer may be formed of $(Y,Gd)BO_3:Eu^{3+}$ phosphors, the green phosphor layer may be formed of $Zn_2SiO_4:Mn^{2+}$ phosphors, and the blue phosphor layer may be formed of $BaMgAl_{10}O_{17}:Eu^{2+}$ phosphors.

The first substrate 101 and the first dielectric layer 110 may be formed with materials with certain thermal expansion coefficients so that a difference between the thermal expansion coefficients of the first substrate 101 and the first dielectric layer 110 may fall within the specified range according to Formula I provided below.

The first substrate 101 may be a high distortion point glass substrate formed of, e.g., a soda lime glass, PD-200 of Asahi Glass Co., Ltd (Japan), CS-77 of Saint-Gobain Performance Plastics Corporation (France), or CP-600 of Central Glass Co., Ltd (Japan). The first dielectric layer 110 may be a transparent dielectric material that may be at least one of a lead-based material, e.g., $PbO—B_2O_3—SiO_2$, a bismuth-based material, e.g., $Bi_2O_3—B_2O_3—SiO_2$, a boron-zinc-based material, e.g., $B_2O_3—ZnO—SiO_2$, and a boron-alumina-based material, e.g., $B_2O_3—SiO_2—Al_2O_3$.

Here, a difference between the thermal expansion coefficient of the first substrate 101 and the thermal expansion coefficient of the first dielectric layer 110 may be about $2\times10^{-7}/°$ C. to about $17\times10^{-7}/°$ C. This relationship may be defined by Formula 1 below.

$$2 \leqq \text{the thermal expansion coefficient of the first substrate 101} - \text{the thermal expansion coefficient of the first dielectric layer 110} \leqq 17 \text{(unit:}\times10^{-7}/°\text{ C.)} \quad \text{<Formula 1>}$$

A defect that may frequently occur in the multi-cutting process technology, which is used in manufacturing of a PDP to improve efficiency, is warping of a panel. In particular, the defect may often occur due to a mismatch between a thermal expansion coefficient of a substrate and a thermal expansion coefficient of a dielectric layer formed on the substrate. When the thermal expansion coefficient of the substrate and the thermal expansion coefficient of the dielectric layer formed on the substrate are mismatched, a strong residual stress may be generated between the substrate and the dielectric layer, thereby weakening a rigidity of the substrate.

In addition, as a panel thickness are reduced, e.g., from a panel thickness of 2.8 mm to 1.8 mm, so as to reduce manufacturing costs, the effect of the mismatched thermal expansion coefficient of the first substrate 101 and the first dielectric layer 110 may even further weaken the rigidity of the substrate.

If the thermal expansion coefficients of the first substrate 101 and the first dielectric layer 110 are limited according to present embodiment, and thus, fall within the specified range, however, a rigidity defect of a substrate due to a mismatch between the thermal expansion coefficients of the first substrate 101 and the first dielectric layer 110 may be reduced.

Table 1 shows experimental results of substrate rigidity and substrate breakage defect ratio of substrates obtained when changing the difference between the thermal expansion coefficients of the first substrate 101 and the first dielectric layer 110.

TABLE 1

| Thermal expansion coefficient of first substrate − thermal expansion coefficient of first dielectric layer ($\times10^{-7}/°$ C.) | Result of substrate rigidity (cm) | Substrate breakage defect ratio (%) |
|---|---|---|
| −5 | 6.6 | 8.7 |
| −3 | 7.6 | 6.7 |
| 0 | 8.2 | 2.7 |
| 1 | 8.9 | 1.4 |
| 2 | 10.3 | 0.8 |
| 5 | 12.5 | 0.4 |
| 10 | 14.7 | 0.1 |
| 15 | 13.1 | 0.1 |
| 17 | 10.2 | 0.9 |
| 18 | 9.2 | 1.2 |
| 20 | 7.5 | 5.5 |
| 22 | 6.8 | 8.5 |

The results shown in Table 1 were obtained from an experiment in which the breakage defect of the substrate was inspected while a difference between the thermal expansion coefficients of the first substrate 101 and the first dielectric layer 110 was changed. Also, a metal ball was dropped from a certain distance to five different areas of the substrate so that the substrate rigidity can be expressed in numeral values, and resulting data thereof was verified by being correlated with the substrate breakage defect ratio.

At this time, the resulting substrate rigidity corresponded to heights at which the metal ball was dropped without creating cracks on the substrate. That is, higher the metal ball was dropped, greater substrate rigidity the substrate possessed. In other words, the fact that substrate was able to withstand the impact of the metal ball that became greater as the metal ball was dropped from a higher distance indicated that the substrate has greater substrate rigidity. The weight of the metal ball used in the experiment was 45 g.

Also, the first substrate 101 may be formed of a material that may be at least one of the PD-200 having the thermal expansion coefficient of about $85\times10^{-7}/°$ C. to about $86\times10^{-7}/°$ C., the soda lime glass having the thermal expansion coefficient of about $86\times10^{-7}/°$ C. to about $87\times10^{-7}/°$ C., the CS-77 having the thermal expansion coefficient of about $77\times10^{-7}/°$ C. to about $79\times10^{-7}/°$ C., and the CP-600 having the thermal expansion coefficient of about $84\times10^{-7}/°$ C. to about $86\times10^{-7}/°$ C.

Referring to Table 1, the substrate rigidity was better when the result of substrate rigidity was about 10.2 cm to about 14.7 cm, that is, when the difference between the thermal expansion coefficients of the first substrate 101 and the first dielectric layer 110 was about $2\times10^{-7}/°$ C. to about $17\times10^{-7}/°$ C., compared to when the difference was less than about $2\times10^{-7}/°$ C. or greater than about $17\times10^{-7}/°$ C.

Thus, a process defect due to the mismatch between the thermal expansion coefficients of the first substrate 101 and the first dielectric layer 110 may be avoided if the thermal expansion coefficients of the first substrate 101 and the first dielectric layer 110 is matched according to Formula 1, where $2\times10^{-7}/°$ C.≦the thermal expansion coefficient of the first substrate 101−the thermal expansion coefficient of the first dielectric layer 110≦$17\times10^{-7}/°$ C. That is, if a defect rate is controlled to be less than 1% in an evaluation of the substrate rigidity, the substrate would be less likely to have the process defect, and thus, may be more reliable.

When the substrate breakage defect ratio is less than 1%, the substrate rigidity may be about 10.2 cm to about 14.7 cm. When the substrate breakage defect ratio is greater than 1%, the substrate rigidity may be about 6.6 cm to about 9.2 cm. Thus, the substrate rigidity may increase more when the substrate breakage defect ratio is less than 1%, which means a difference between the thermal expansion coefficients of the first substrate 101 and the first dielectric layer 110 is about $2\times10^{-7}/°$ C. to about $17\times10^{-7}/°$ C., compared to when the substrate breakage defect ratio is greater than 1%.

Table 2 shows results of another experiment of matching the thermal expansion coefficients of the first substrate 101 and the first dielectric layer 110. Unlike the previous experiment, which results are shown in Table 1, a material forming the first dielectric layer 110 was changed in each example, while a material of the front substrate 101 remained the same.

TABLE 2

| | Thermal expansion coefficient of first substrate | Thermal expansion coefficient of first dielectric layer | Thermal expansion coefficient of first substrate – thermal expansion coefficient of first dielectric layer (×10−7/° C.) | Result |
|---|---|---|---|---|
| Example 1 | 85 | 70 (lead-based) | 5 | Excellent |
| Example 2 | 85 | 83 (bismuth-based) | 2 | Excellent |
| Example 3 | 85 | 84 (bismuth-based) | 17 | Excellent |
| Example 4 | 85 | 68 (lead-based) | 10 | Excellent |
| Comparison 1 | 85 | 67 (lead-based) | 18 | Breakage |
| Comparison 1 | 85 | 84 (bismuth-based) | 1 | Breakage |

The results shown in Table 2 were obtained from the experiment in which the breakage defect of the substrate was inspected, while the material of the first dielectric layer 110 was changed to change the difference between the thermal expansion coefficients of the first substrate 101 and the first dielectric layer 110. The thermal expansion coefficient of the first substrate 101 remained constant. Since experimental conditions of Table 2 are the same as those of Table 1, a detailed description thereof will be omitted here.

The PD-200 having the thermal expansion coefficient of $85\times10^{-7}/°$ C. was used as the first substrate 101, and the material of at least one of the lead-based material, e.g., PbO—$B_2O_3$—$SiO_2$, the bismuth-based material, e.g., $Bi_2O_3$—$B_2O_3$—$SiO_2$, the boron-zinc-based material, e.g., $B_2O_3$—ZnO—$SiO_2$, and the boron-alumina-based material, e.g., $B_2O_3$—$SiO_2$—$Al_2O_3$, was used as the first dielectric layer 110.

Referring to Table 2, in examples 1 to 4, where the difference in the thermal expansion coefficients of the first substrate 101 and the first dielectric layer 110 was about $2\times10^{-7}/°$ C. to about $17\times10^{-7}/°$ C., the first substrate 101 was not damaged. Alternatively, in Comparisons 1 and 2, where the difference between the thermal expansion coefficients of the first substrate 101 and the first dielectric layer 110 was less than about $2\times10^{-7}/°$ C. or greater than about $17\times10^{-7}/°$ C., the first substrate 101 was damaged.

As described above, the PDP according to the embodiments has a structure in which the thermal expansion coefficients of the substrate and the dielectric layer formed on the substrate are limited by a specific formula, and is thereby capable of reducing or preventing the substrate rigidity defect due to the mismatch between the thermal expansion coefficients of the substrate and the dielectric layer.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display panel (PDP), comprising:

a first substrate and a second substrate facing each other;

a plurality of first discharge electrodes on the first substrate;

a first dielectric layer covering the plurality of first discharge electrodes, the first dielectric layer including at least one of a lead-based material, a bismuth-based material, and a boron-alumina-based material;

a plurality of second discharge electrodes on the second substrate to cross the plurality of first discharge electrodes;

a second dielectric layer covering the plurality of second discharge electrodes;

a plurality of barrier ribs disposed between the first substrate and the second substrate and partitioning a plurality of discharge cells; and a plurality of phosphor layers formed in the plurality of discharge cells, wherein a difference between thermal expansion coefficients of the first substrate and the first dielectric layer is greater than or equal to $2\times10^{-7}/°$ C. and less than or equal to $17\times10^{-7}/°$ C.

2. The PDP as claimed in claim 1, wherein the plurality of first discharge electrodes are a plurality of pairs of sustain electrodes disposed in a direction of the first substrate, and the plurality of second discharge electrodes are a plurality of address electrodes disposed in a direction of the second substrate.

3. The PDP as claimed in claim 1, wherein the first substrate is formed of a high distortion point glass having the thermal expansion coefficient of about $77\times10^{-7}/°$ C. to about $87\times10^{-7}/°$ C.

4. The PDP as claimed in claim 1, further comprising a protective layer on a surface of the first dielectric layer.

5. The PDP as claimed in claim 1, wherein the lead-based material has the thermal expansion coefficient of about $60\times10^{-7}/°$ C. to about $85\times10^{-7}/°$ C., the bismuth-based material has the thermal expansion coefficient of about $65\times10^{-7}/°$ C. to about $90\times10^{-7}/°$ C., and the boron-alumina-based material has the thermal expansion coefficient of about $70\times10^{-7}/°$ C. to about $90\times10^{-7}/°$ C.

6. The PDP as claimed in claim 1, wherein the first substrate is a substrate through which visible light penetrates.

7. A PDP, comprising:

a substrate;

a plurality of discharge electrodes disposed on the substrate; and a dielectric layer formed to cover the plurality of discharge electrodes, the dielectric layer including at least one of a lead-based material, a bismuth-based material, and a boron-alumina-based material, wherein a difference between thermal expansion coefficients of the substrate and the dielectric layer is greater than or equal to $2\times10^{-7}/°$ C. and less than or equal to $17\times10^{-7}/°$ C.

8. The PDP as claimed in claim 7, wherein the substrate is formed of a high distortion point glass having the thermal expansion coefficient of about $77\times10^{-7}/°$ C. to about $87\times10^{-7}/°$ C.

9. The PDP as claimed in claim 7, wherein the lead-based material has the thermal expansion coefficient of about $60\times10^{-7}/°$ C. to about $85\times10^{-7}/°$ C., the bismuth-based material has the thermal expansion coefficient of about $65\times10^{-7}/°$ C. to about $90\times10^{-7}/°$ C., and the boron-alumina-based material has the thermal expansion coefficient of about $70\times10^{-7}/°$ C. to about $90\times10^{-7}/°$ C.

10. The PDP as claimed in claim 7, wherein the plurality of discharge electrodes are a plurality of pairs of sustain electrodes.

11. The PDP as claimed in claim 7, wherein the substrate is a substrate through which visible light penetrates.

12. The PDP as claimed in claim 7, further comprising a protective layer on a surface of the dielectric layer.

* * * * *